US005711498A

United States Patent [19]

Wittlinger et al.

[11] Patent Number: 5,711,498

[45] Date of Patent: Jan. 27, 1998

[54] FLEXIBLE-BAG SUPPORT FRAME WITH BAG CLOSER/COVER

[76] Inventors: Roy P. Wittlinger; Claire E. Wittlinger, both of 945 N. Old State Rd., Delaware, Ohio 43015

[21] Appl. No.: 645,429

[22] Filed: May 13, 1996

[51] Int. Cl.[6] ..... A63B 55/04

[52] U.S. Cl. ..... 248/97

[58] Field of Search ..... 248/97, 99, 100, 248/101, 95, 907

[56] References Cited

U.S. PATENT DOCUMENTS 2,723,099 11/1955 Smith et al. ..... 248/907 X
3,352,520 11/1967 Bumgarner et al. ..... 248/97 X
3,822,845 7/1974 Kennedy et al. ..... 248/907 X
4,188,005 2/1980 Lee ..... 248/97
4,307,891 12/1981 Simpson et al. ..... 248/97

*Primary Examiner*—Ramon O. Ramirez

[57] ABSTRACT

A flexible-bag support frame with an integral bag closer/cover is disclosed. The frame suspends within a trihedral-shaped rim and trihedral-shaped base a flexible bag with handles so that the bag's open end is up. The trihedral-shaped rim is designed to work with the bag closer/cover which may be set either to prevent or to allow access to the open end of the bag. When set to allow access, the closer/cover helps keep trash or other materials being placed into the bag from spilling along side of the bag. The disclosed device facilitates recycling of plastic grocery bags for use as trash bags.

2 Claims, 4 Drawing Sheets

FLEXIBLE-BAG SUPPORT FRAME WITH BAG CLOSER/COVER

BACKGROUND—FIELD OF THE INVENTION

This invention relates to a support frame for flexible bags with handles, more specifically to a support frame with an integral bag closer/cover device.

BACKGROUND—DESCRIPTION OF PRIOR ART

The disposal of Wash is one mundane task people must address in all households and workplaces. To dispose of daily trash many people simply expand a paper grocery bag, set the bag on the floor to fill with trash, and then throw the filled bag out. Paper grocery bags have sufficient rigidity to stand alone so that people can recycle them as trash bags in this way.

However, plastic grocery bags are not sufficiently rigid to stand alone on the floor. Therefore, people must find some means of supporting these bags in an upright expanded position in order to recycle them as trash bags. Therefore, people often line a waste basket with the plastic bag, or hang the bag from a handle on a cabinet. However, these jerry-rigged means of bag suspension are less than satisfactory. There are problems associated with bag size relative to size of the waste basket when using the bags as a liner, and there are problems holding the bag open when simply suspending it from a handle.

Accordingly, there remains a need for a self-standing bag frame which incorporates a device that makes trash or other items placed in the bag inaccessible by closing and/or covering the open end of the bag. Further, in order for the closer/cover device to work easily with bags of different sizes, the device must not require that bags be pulled up, over and around a rim of the support frame. Further, the closer/cover device must operate within the space occupied by the frame for the frame to be placed under a table, desk or similar confined space.

OBJECTS AND ADVANTAGES

The principal object of the present invention is to provide a flexible bag support frame with a bag closer/cover which facilitates the recycling of plastic grocery bags for use as trash bags. Accordingly, several other objects and advantages of this invention are:

1. To provide a support frame which suspends entirely within the frame a flexible bag with handles, bag open end up;
2. To incorporate as part of the support frame a device which closes and covers the open end of a bag such that trash in the bag can be made inaccessible;
3. To provide a closer/cover device which in its open position helps prevent trash from spilling around the bag;
4. To provide a closer/cover device that operates entirely within the space occupied by the support frame;
5. To provide a support frame which allows for easy insertion and removal of flexible bags;
6. To provide a support frame which allows flexible bags to be filled to capacity;
7. To provide a support frame which allows a range of sizes of flexible bags to be used;
8. To provide a self-standing support frame that fits in the corner of a room with minimal protrusion from the corner;

9. To provide a support frame that will be stable, whether placed on an even or uneven horizontal surface.

DRAWING FIGURES

The structure and operation of the present invention will be more clearly understood by referring to the accompanying figures, illustrative of the preferred embodiment, in which.

Figure 1:
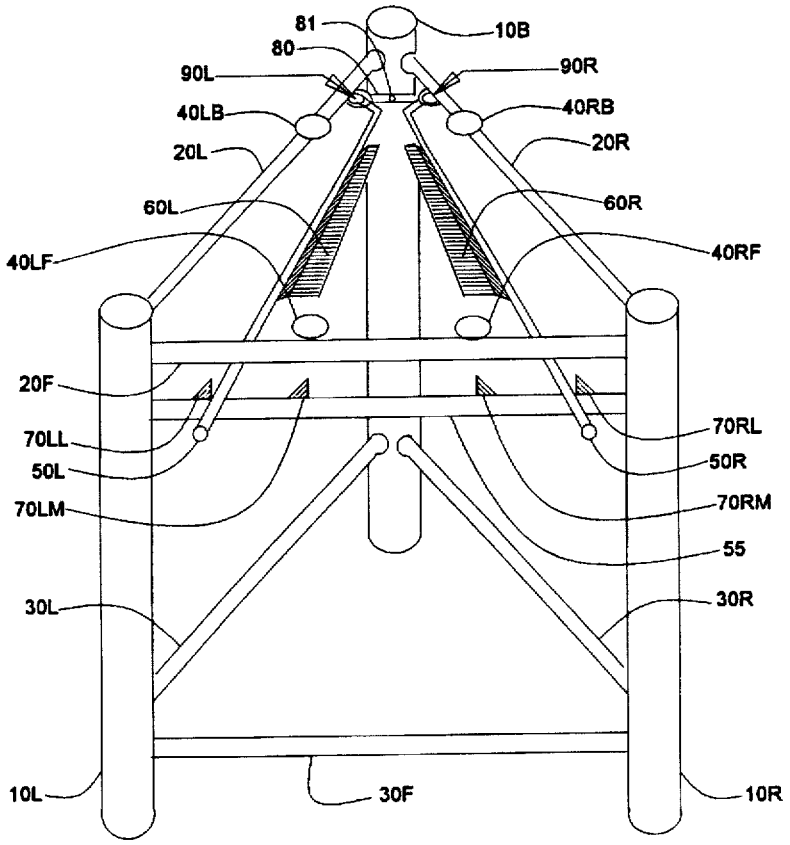
FIG. 1 is a front perspective view of the support frame and the bag closer/cover device.

Reference Numerals in Drawings:

| | | | |
|---|---|---|---|
| 10L | left front leg | 10R | right front leg |
| 10B | back leg | 20F | front rim rod |
| 20L | left rim rod | 20R | right rim rod |
| 30F | front base rod | 30L | left base rod |
| 30R | right base rod | 40LF | bag anchor |
| 40RF | bag anchor | 40LB | bag anchor |
| 40RB | bag anchor | 50L | left swing rod |
| 50R | right swing rod | 55 | guide rod for swing rods |
| 60L | left cover | 60R | right cover |
| 70LL | left lateral cleat | 70LM | left medial cleat |
| 70RM | right medial cleat | 70RL | right lateral cleat |
| 80 | bracket | 81 | screw |
| 90L | attachment assembly | 90R | attachment assembly |
| 91 | bolt | 92 | washer |
| 93 | nut | 95 | bag handle |
| 99 | flexible bag | | |

SUMMARY

There is need for a flexible-bag support frame which facilitates economical, hygienic, and environmentally conscious disposal of household and workplace trash. The present invention meets this need. In effect, the present invention is a trash frame which supports within it a flexible grocery bag, open end up, so that the bag may be recycled as a trash bag. The rim and the base of this stand-alone trash frame form an equilateral triangle. A closer/cover device, designed to work with the properties of this triangle, can be set either to prevent or to provide access to the open end of the bag.

DESCRIPTION

Figure 2:
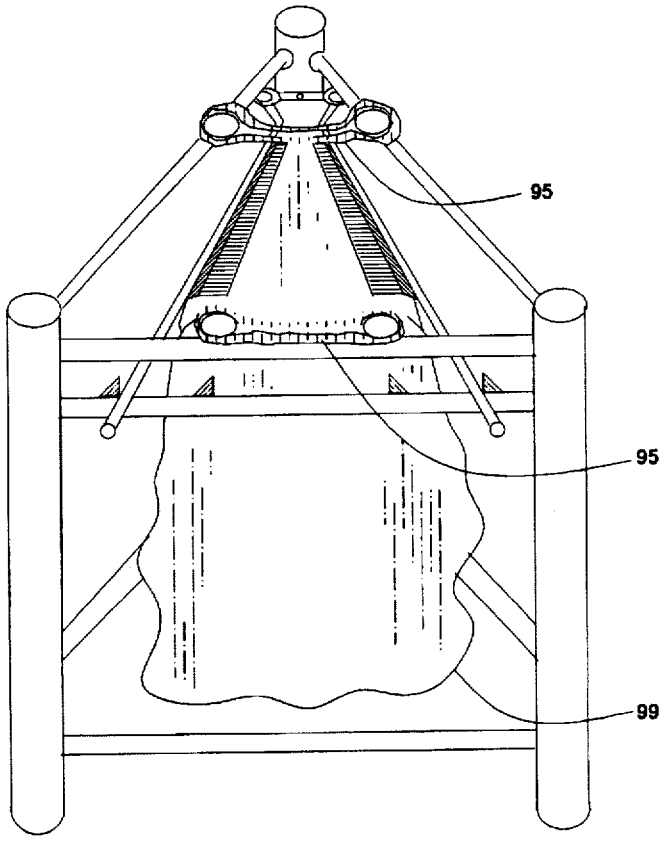
FIG. 2 is a front perspective view of the structure in FIG. 1 with bag installed thereon.

FIG. 1 shows a perspective view of the preferred embodiment of the present invention. FIG. 2 shows a perspective view of the device shown in FIG. 1 with a flexible bag attached thereon. As is apparent in FIG. 1 and FIG. 2, rods or dowels 10L, 10R, and 10B form three vertical components of a frame; rods 20L, 20R, and 20F are positioned horizontally and secured to these vertical rods to form the top rim of a frame. Further, rods 30L, 30R, and 30F are positioned horizontally and secured to these vertical rods to form the base of a frame.

Figure 4:
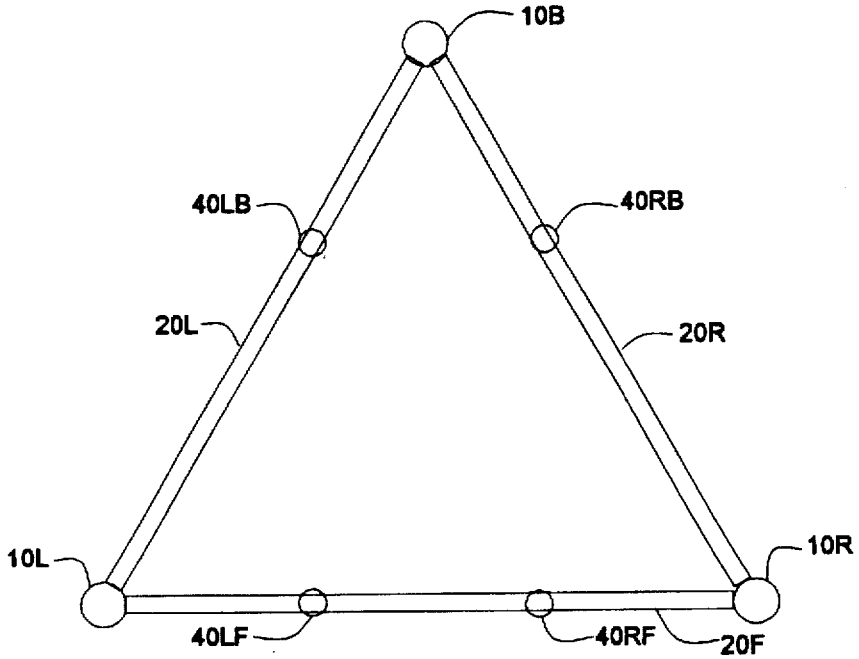
FIG. 4 is a top plan view of the structure in FIG. 1 without bag closer/cover device.

In one embodiment of the support frame, all vertical rods are 18 inches long, 1.25 inches in diameter, and made of wood; and all horizontal rods are 18 inches long, 0.5 inch in diameter and made of wood. Rods 20L, 20R, and 20F are attached to rods 10L, 10R, and 10B so that the rim of the frame forms an equilateral triangle. FIG. 4, which is a top plan view of the frame, clearly shows the rim of trihedral shape. Rods 20L, 20R, and 20F are attached to the vertical rods at 1 inch from the top of the vertical rods. Rods 30L, 30R, and 30F are attached to rods 10L, 10R, and 10B so that the base of the frame also forms an equilateral triangle. Horizontal rod 30F is attached to rod 10L and rod 10R 1 inch from their bottom. Horizontal rod 30L is attached to vertical rod 10L and vertical rod 10B 6 inches from the bottom of these two vertical rods; and horizontal rod 30R is attached to vertical rod 10R and vertical rod 10B 6 inches from the bottom of these two vertical rods.

FIG. 1 and FIG. 2 also show anchors 40LF, 40RF, 40LB, and 40RB attached to the top side of the rim of the frame. In one embodiment of the support frame, these anchors are 0.5 inch in diameter and 0.5 inch high. Anchor 40LF is positioned on rod 20F 6 inches medial to rod 10L; anchor 40RF is positioned on rod 20F 6 inches medial to rod 10R; anchor 40LB is positioned on rod 20L 6 inches in front of rod 10B; and anchor 40RB is positioned on rod 20R 6 inches in front of rod 10B. The handles of flexible bags are secured to these anchors such that the bag is suspended open end up within the frame.

Figure 3:
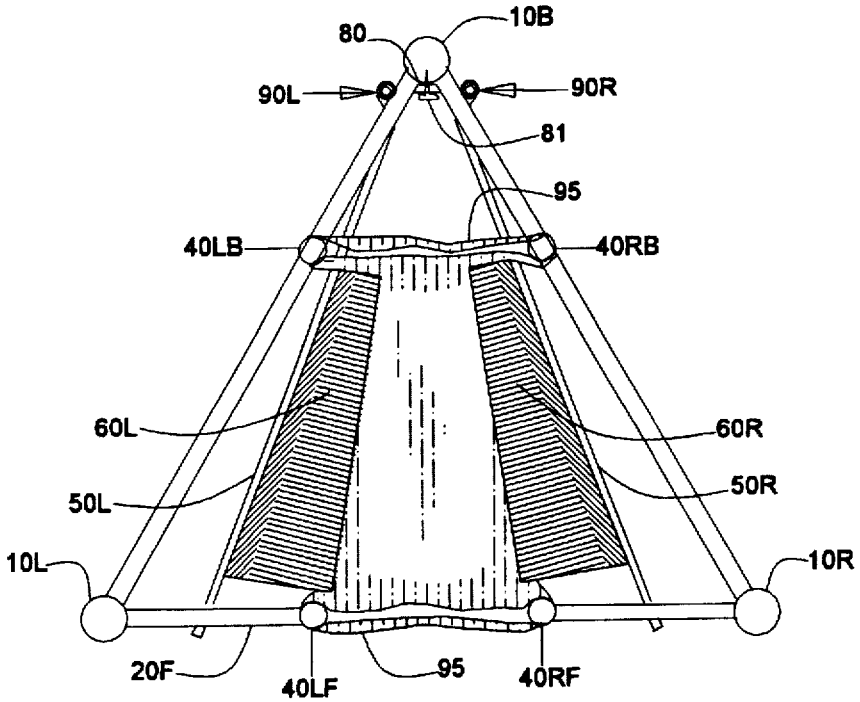
FIG. 3 is a top plan view of the structure in FIG. 1 with bag installed thereon.
Figure 8:
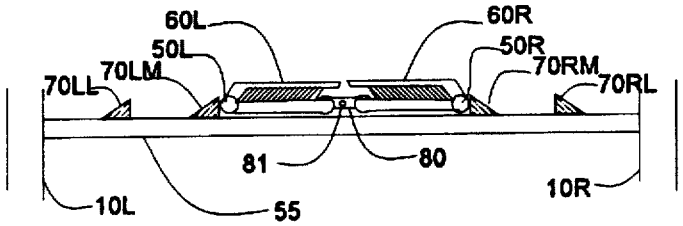
FIG. 8 is a from elevation view of closer/cover device.

FIG. 1, FIG. 2, and FIG. 3 also show components of a closer/cover assembly. This assembly is comprised of a cover 60L attached to a swing rod 50L and a cover 60R attached to a swing rod 50R. In one embodiment of the assembly, the covers are made of plastic and the swing rods of metal 0.25 inch in diameter. The front of cover 60L measures 2.8 inches from left to right in a horizontal plane; the back measures 1.2 inches from left to right in a horizontal plane; and the length measures 8.7 inches from front to back on the medial edge in a horizontal plane. The lateral edge of cover 60L is bonded or secured to swing rod 50L. Cover 60L rises at a 60 degree incline from where it is secured to swing rod 50L to 1 inch above swing rod 50L at which point it becomes horizontal. This incline is explicitly shown in FIG. 8 which presents a front elevation view of the closer/cover assembly. Cover 60R and swing rod 50R form the horizontal mirror image of cover 60L and swing rod 50L.

FIG. 1 also shows a horizontal rod 55 attached to vertical rods 10L and 10R. In one embodiment of the closer/cover assembly, horizontal rod 55 is attached to vertical rods 10L and 10R 1.5 inches below horizontal rod 20F. Four cleats 0.5 inch high are attached to the top side of horizontal rod 55. Cleat 70LM is positioned 6 inches from the left end of rod 55 and directly under anchor 40LF. Cleat 70RM is positioned 6 inches from the right end of rod 55 and directly under anchor 40RF. Cleat 70LL is positioned 3 inches from the left end of rod 55 and cleat 70RL is positioned 3 inches from the right end of rod 55.

Figure 5:
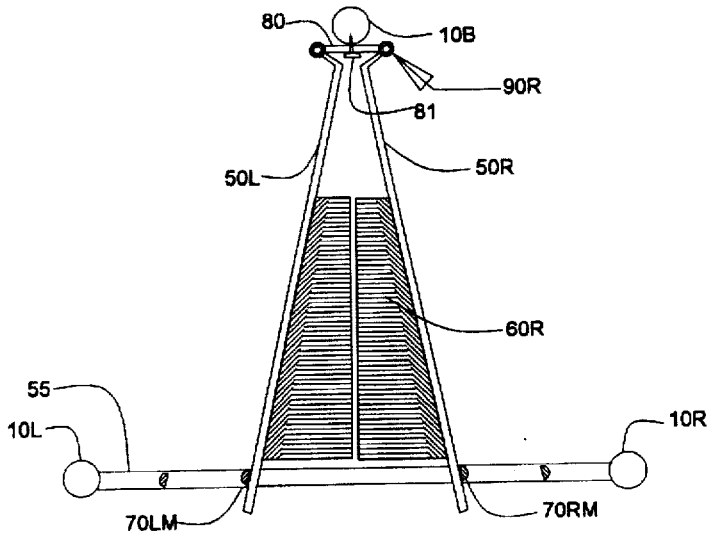
FIG. 5 is a top plan view of closer/cover device in closed position.
Figure 6:
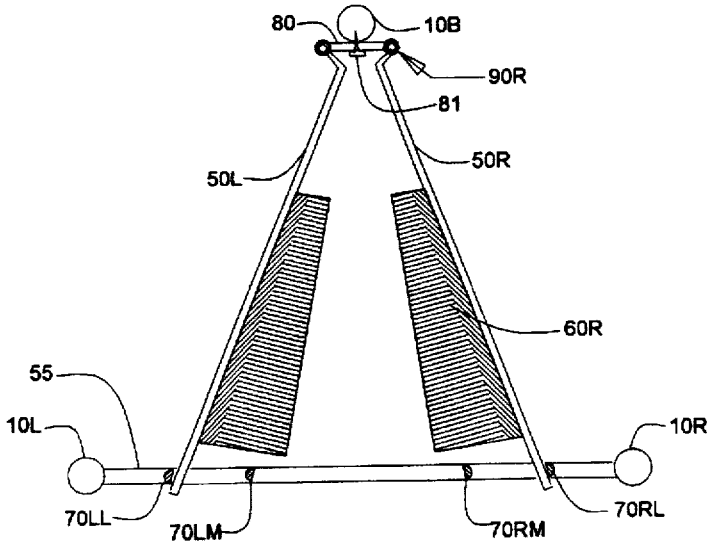
FIG. 6 is a top plan view of closer/cover device in open position.
Figure 7:
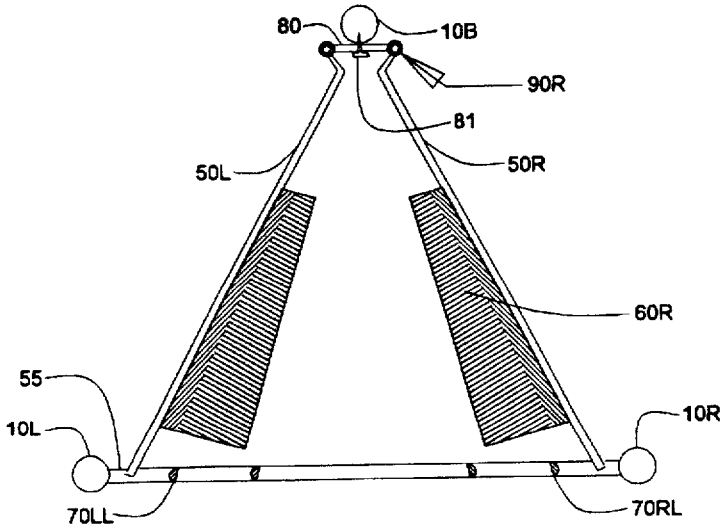
FIG. 7 is a top plan view of closer/cover device in bag-insertion/removal position.
Figure 9:
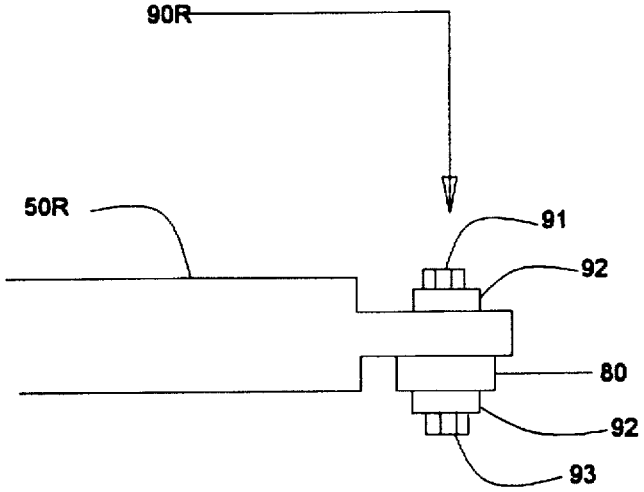
FIG. 9 is a side elevation view of attachment assembly.

FIG. 5, FIG. 6, and FIG. 7 present in a plan view the closer/cover assembly in detail. As is apparent in those figures, swing rods 50L and 50R attach to bracket 80 at the back of the frame and extend to horizontal guide rod 55. Bracket 80 measures 2 inches from left to right and is secured to vertical rod 10B by screw 81. On each end, bracket 80 has a horizontal flat surface with a 0.125 inch hole. As shown in FIG. 9, a bolt, trasher, and nut assembly secure swing rod 50R, to the right end of bracket 80. An identical bolt, trasher, and nut assembly secure swing rod 50L to the left end of bracket 80.

One inch in front of its attachment to bracket 80, swing rod 50L has a 90 degree bend to the left and 1 inch in front of its attachment to bracket 80, swing rod 50R has a 90 degree bend to the right. Top plan views of the closer/cover assembly presented in FIG. 5, FIG. 6, and FIG. 7 show these two bends. These three figures also explicitly show swing rods 50L and 50R in three positions. In FIG. 5 swing rod 50L is medial to cleat 70LM and swing rod 50R is medial to cleat 70RM which puts the closer/cover assembly in closed position. In FIG. 6 swing rod 50L is between cleat 70LM and cleat 70LL and swing rod 50R is between cleat 70RM and cleat 70RL which puts the closer/cover assembly in open position. In FIG. 7 swing rod 50L is lateral to cleat 70LL and swing rod 50R is lateral to cleat 70RL which puts the closer/cover assembly in position for insertion and removal of flexible bags. When a flexible bag is in the frame and when swing rods 50L and 50R are in the closed position, the swing rods contact the sides of the bag from front to back which provides a seal between the bag and the closer/cover assembly.

In other embodiments of the closer/cover assembly, rods and covers may be made of plastic, metal or other suitable material; and rods and covers may be of different dimensions.

OPERATION

Operation of the present invention involves insertion of an empty flexible bag into the support frame and removal of a full flexible bag from the support frame. Further, once a bag has been inserted, operation involves setting the closer/cover assembly in one position that provides access to the open end of the bag or in a second position that prevents access to the open end of the bag.

Insertion and removal of a flexible bag are best understood by referring to FIG. 2 and FIG. 7. To insert an empty bag, one sets the closer/cover assembly in the bag insertion/removal position as shown in FIG. 7. Then one inserts the bag through the top of the support frame attaching the bag handles to the anchors on the rim of the frame as is apparent in FIG. 2. At this point the bag is suspended within the frame, open end up as shown in FIG. 2. To remove a full bag, one first sets the closer/cover assembly in the bag insertion/removal position. Then one removes the bag handles from the anchors, drops the bag below rod 55, and pulls the bag out the front of the frame. Rod 55 and rod 30F are sufficiently spaced apart vertically to provide a large opening for bag removal.

Operation of the closer/cover assembly is best understood by referring to FIG. 5, FIG. 6, and FIG. 7. As apparent in those figures, bag insertion and removal involves setting swing rod 50L and swing rod 50R lateral to cleat 70LL and cleat 70RL, respectively. To close the open end of the bag, one sets swing rod 50L and swing rod 50R medial to cleat 70LM and cleat 70RM, respectively. To open the closer/cover assembly to provide access to the bag, one sets swing rod 50L between cleat 70LL and cleat 70LM and swing rod 50R between cleat 70RL and cleat 70RM. Thus, the two swing rods are placed in one of three positions for bag-closed, bag-opened, or bag-insertion/removal operation.

The closer/cover design is best shown in FIG. 3. At the back of the frame, the closer/cover assembly has less cover than it does at the front of the frame. Conversely, the closer/cover swing rods close the bag more at the back of the frame than they do at the front. At the back of the frame, the flexible bag handles are suspended over anchors 40LB and 40RB which are 6 inches apart. At the front of the frame, the flexible bag handles are suspended over anchors 40LF and 40RF which are also 6 inches apart.

The closer/cover assembly is positioned relative to the bag anchors such that moving the assembly from a lateral to a medial position pulls the bottom of the bag up. Further, lateral-to-medial movement pulls the bottom of the bag up more at the back of the frame than at the front of the frame. Still further, the bends in swing rod 50L and swing rod 50R, combined with the positions where these two rods attach to bracket 80, pull the bag slightly toward the back of the frame as the rods move from a lateral to a medial position.

Thus, the action of the closer/cover assembly produces a tension gradient on the bag, especially a bag that is filled near capacity, with more tension on the back of the bag than on the front. This tension gradient has the desired effect of pulling the front of the bag toward the back of the frame, which helps keep a full bag from bulging out the front of the frame. Rod 30L and rod 30R keep a full bag from bulging out the other two sides of the frame.

The bends in the swing rods, together with the positions of attachment of the swing rods on bracket 80, also help keep the front ends of the rods from protruding out the front of the support frame as the rods move from a lateral position to a medial position along guide rod 55.

Finally, in its open-bag position, the surface of the closer/cover assembly slightly extends over the sides of the flexible bag. This helps keep trash being placed in the bag from spilling down the side of the bag. If coffee grounds or other trash spills outside the flexible bag and onto the cover, one simply pushes it off the cover and into the bag.

CONCLUSION, RAMIFICATIONS, AND SCOPE

As disclosed above, the present invention achieves its principal object of facilitating recycling of plastic grocery bags with handles as trash bags. Additionally, the support frame with bag closer/cover described here achieves all other objects listed above. In particular, the support frame provides an integral device that closes and covers the open end of a bag such that trash in the bag can be made inaccessible. Further, when in its open position, the closer/cover device has the advantage of helping to prevent trash from spilling around the bag. Further, in its bag-insertion/removal position, the closer/cover is out of the way enabling easy insertion of a bag from above the frame or enabling the handles of filled bags to be slipped off the bag anchors readying the bag for removal. With handles freed, the bag can then easily be removed through the large opening provided in front of the frame. Also, the closer/cover operates within the space occupied by the support frame allowing the frame to be placed under a desk, table or other area too confining for a swing-up cover. Still further, the support frame allows plastic bags to be filled to capacity. Yet further, stretching the handles of a smaller bag to the point where the handles slip on the bag anchors allows a range of bag sizes to be used. There is no need to pull the bag up, over and around the rim of the support frame to secure the bag to the frame. Finally, a trihedral base allows the free-standing frame to remain stable, whether the frame is placed on uneven or even floors; and the trihedral shape of the frame is ideal for placing the self-standing frame in the corner of a room.

While the preferred embodiment of the invention has been described, it should be understood that the invention is not limited thereto, since there are variations that will be readily apparent to those skilled in the art. Thus, it is intended that the invention be given the broadest possible interpretation within the term of the claims which follow.

We claim:

1. A fame for suspending a flexible bag of the type having handles, said frame comprising:

a) a first, second and third vertical rod, having upper and lower ends and positioned in a triangular fashion;

b) a first set of three horizontal rods, each rod secured at the corresponding upper ends of two of said vertical rods, such that said first set of horizontal rods defines a triangular top rim;

c) a second set of three horizontal rods, each rod secured at the corresponding lower ends of two of said vertical rods, such that said second set of horizontal rods defines a triangular base;

d) a plurality of anchors attached at spaced locations to said first set of horizontal rods for receiving and securing the handle of the bag; wherein the bag is suspended between the triangular top rim and base.

2. The frame of claim 1 further comprising:

a) another horizontal rod adjacent and parallel to one of the rods of said first set of horizontal rods, connecting the first and second vertical rods;

b) a bracket attached to the third vertical rod;

c) a plurality of cleats attached at spaced locations to said another horizontal rod;

d) two swing rods, each pivotally attached at one end to said bracket, such that said swing rods move through a separate predetermined arc in a horizontal plane defined by said another horizontal rod, said predetermined arc defined by the location of said cleats;

e) two flat structures, each secured to each of said swing rods; wherein when said swing rods pivot to a close position, said flat structures cover the open end of the bag, and when they pivot apart, the flat structures uncover the open end of the bag.

* * * * *